US007975950B2

(12) United States Patent
Ebadian et al.

(10) Patent No.: US 7,975,950 B2
(45) Date of Patent: Jul. 12, 2011

(54) MEMORY DISK CRUSHER AND METHOD

(75) Inventors: M. Ali Ebadian, Weston, FL (US); William Olliges, Palm City, FL (US)

(73) Assignee: Phiston Technologies, Inc., Weston, FL (US)

( * ) Notice: Subject to any disclaimer, the term of this patent is extended or adjusted under 35 U.S.C. 154(b) by 40 days.

(21) Appl. No.: 12/432,585

(22) Filed: Apr. 29, 2009

(65) Prior Publication Data

US 2010/0276524 A1 Nov. 4, 2010

(51) Int. Cl.
*B02C 25/00* (2006.01)

(52) U.S. Cl. ..... 241/263; 241/262

(58) Field of Classification Search ..... 241/262, 241/263; 100/94, 95, 96, 98 A, 902
See application file for complete search history.

(56) References Cited

U.S. PATENT DOCUMENTS

| | | | | |
|---|---|---|---|---|
| 4,507 | A * | 5/1846 | Clark | 241/263 |
| 4,272,032 | A * | 6/1981 | Hellberg | 241/263 |
| 4,291,618 | A * | 9/1981 | Heiser et al. | 100/35 |
| 7,861,956 | B2 * | 1/2011 | Hiller, Sr. | 241/30 |

* cited by examiner

*Primary Examiner* — Faye Francis
(74) *Attorney, Agent, or Firm* — McHale & Slavin, P.A.

(57) ABSTRACT

An apparatus and method are provided for destroying memory devices like hard drives by compression and positive predetermined bending of the memory media inside the memory device. The apparatus includes a pair of opposed compression plates with one being movable toward the other by a linear motion force applying drive. An automatic stripper is provided to strip any memory device retained on one of the compression plates.

24 Claims, 8 Drawing Sheets

MEMORY DISK CRUSHER AND METHOD

FIELD OF INVENTION

The invention relates to a device for destroying electronic memory media devices.

BACKGROUND OF THE INVENTION

The finding of discarded electronic storage media still containing data has recently made news. People believed the data had been deleted when a data storage device had been removed and discarded. Computers with information still in the memory have been sold or discarded. Some of these devices contained classified government information and some contained highly sensitive and valuable personal data. The high profile media coverage of some of these happenings and the potential liability and losses from such disclosures have made it more important than ever to provide extra security against such inadvertent loss of information. Now, rather than subject a memory media to erasure of information, there is a move to physically destroy memory media.

While certain memory media may be easily destroyed, like flash memory, so called hard drives with rotating memory storage disks may need extra destruction to help ensure that fragments of the memory disk are small enough that meaningful data cannot be easily extracted from them. One solution to this problem is to shred the hard drive, but such equipment is expensive, noisy and requires maintenance to ensure proper shredding. Such equipment is also not necessarily suited for use in many environments like an office. Such equipment can also be dangerous to use and might provide an opportunity for misuse which can present dangers to a user.

Hard drives for PC's and laptops tend to be of a standard size and shape so they will fit in a bay of predetermined size. The present invention takes advantage of this to provide an apparatus to destroy a hard drive that is of simple construction, positive operation and adapted to use in many environments, including offices without the need for a skilled operator.

SUMMARY OF INVENTION

The invention involves the provision of an apparatus for destroying electronic memory media. The apparatus utilizes both compression and forced reliable bending to ensure fragmenting of the memory disk inside a hard drive. The device includes a support assembly to carry a drive apparatus and tie other components together. The drive apparatus includes a linearly movable member and is coupled to a control system to selectively control movement of the member. The movable member can be part of a hydraulic cylinder with a movable ram. A plate is mounted on the ram for movement toward and away from another plate mounted on the support assembly. The plates have complimentary exposed faces facing generally toward one another. The face on the movable plate has a cavity partially defined by a rib. A second plate is carried by the support assembly and has an exposed second face facing generally toward the first face, The second plate has at least one protuberance projecting therefrom that is sized and shaped to fit within a respective cavity. The rib and the protuberance are preferably configured to bias retention, should retention occur, of a crushed memory device on the first plate during retraction of the first plate by movement of the ram. A stripper mechanism is carried by the support assembly and is operably associated with the movable first plate such that when the first plate moves away from the second plate, the stripper mechanism has a portion that moves inwardly to engage a portion of a memory device carried by the first plate to effect its release from the first plate if it is retained thereon.

The present invention also involves the provision of a method of destroying an electronic memory device by compression and bending. The method includes placing a memory device, such as a PC or laptop hard drive between a movable plate and a preferably fixed plate. The movable plate has a cavity and the other plate has a corresponding protuberance for receipt in the cavity when the plates are in a closed configuration. The movable plate is moved toward the fixed plate and force is applied to the memory device to compress it between the plates during the closing movement. Portions of the memory device are also bent about at least one a portion of cavity defining means and a portion of protuberance defining means. A compressed memory device is automatically released from retention on one of the plates upon moving the plates apart during opening movement.

DETAILED DESCRIPTION OF THE INVENTION

Figure 1:
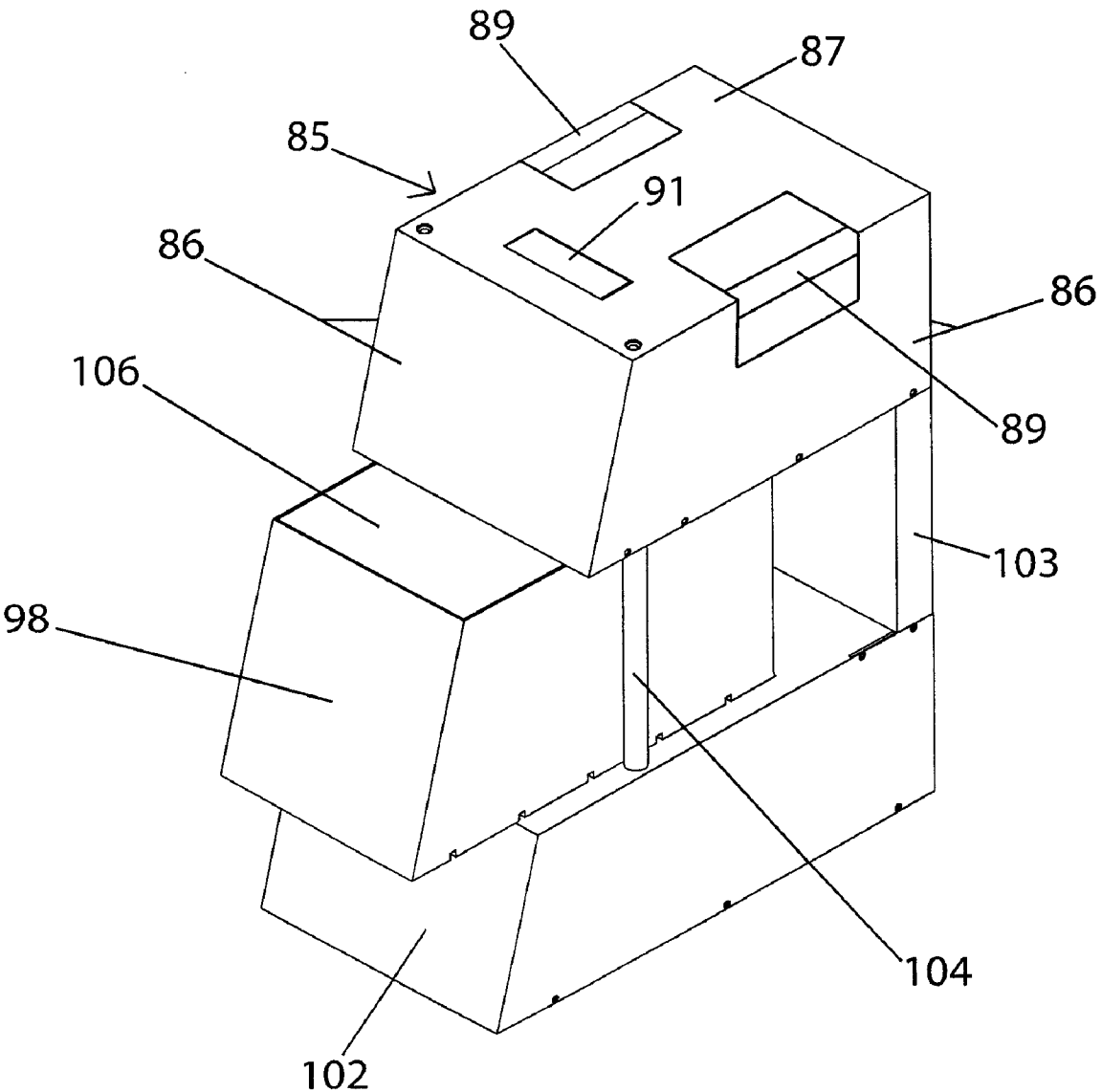
FIG. 1 is a perspective view of an apparatus for crushing memory media showing a hopper in a partially out position.

While the present invention is susceptible of embodiment in various forms, there is shown in the drawings and will hereinafter be described presently preferred embodiments with the understanding that the present disclosure is to be considered an exemplification of the invention and is not intended to limit the invention to the specific embodiments illustrated.

The reference numeral 1 designates generally an apparatus for destroying an electronic memory media device 2 such as a hard drive from a PC or laptop computer. The apparatus 1 includes a compression assembly 3 that is adapted to both compress the memory device 2 and to positively bend it in given areas to ensure fracture of the memory media (not shown) inside the memory device. A typical hard drive has a housing 4 that contains electronic components, a drive motor, data pickups and one or more rotating disks that store digital or analog data. The apparatus 1 includes an enclosure 7 enclosing various of the components of the apparatus 1 including the compression assembly 3. The compression or crusher assembly 3 includes a pair of opposed plates 5,6 with one preferably being fixed and one being movable. The plates 5, 6 are mounted in a support assembly, designated generally 8, which is in turn positioned in the enclosure 7. The support assembly 8 ties components of the compression assembly 3 together. The compression assembly 3 includes a power drive system designated generally 10 that has a portion operably coupled to at least one of the plates 5, 6 to effect relative movement therebetween. With a memory device 2 positioned between the plates 5, 6, movement of the plate 5 toward the plate 6 will effect crushing and predetermined bending of the memory device 2 resulting in its destruction.

Figure 3:
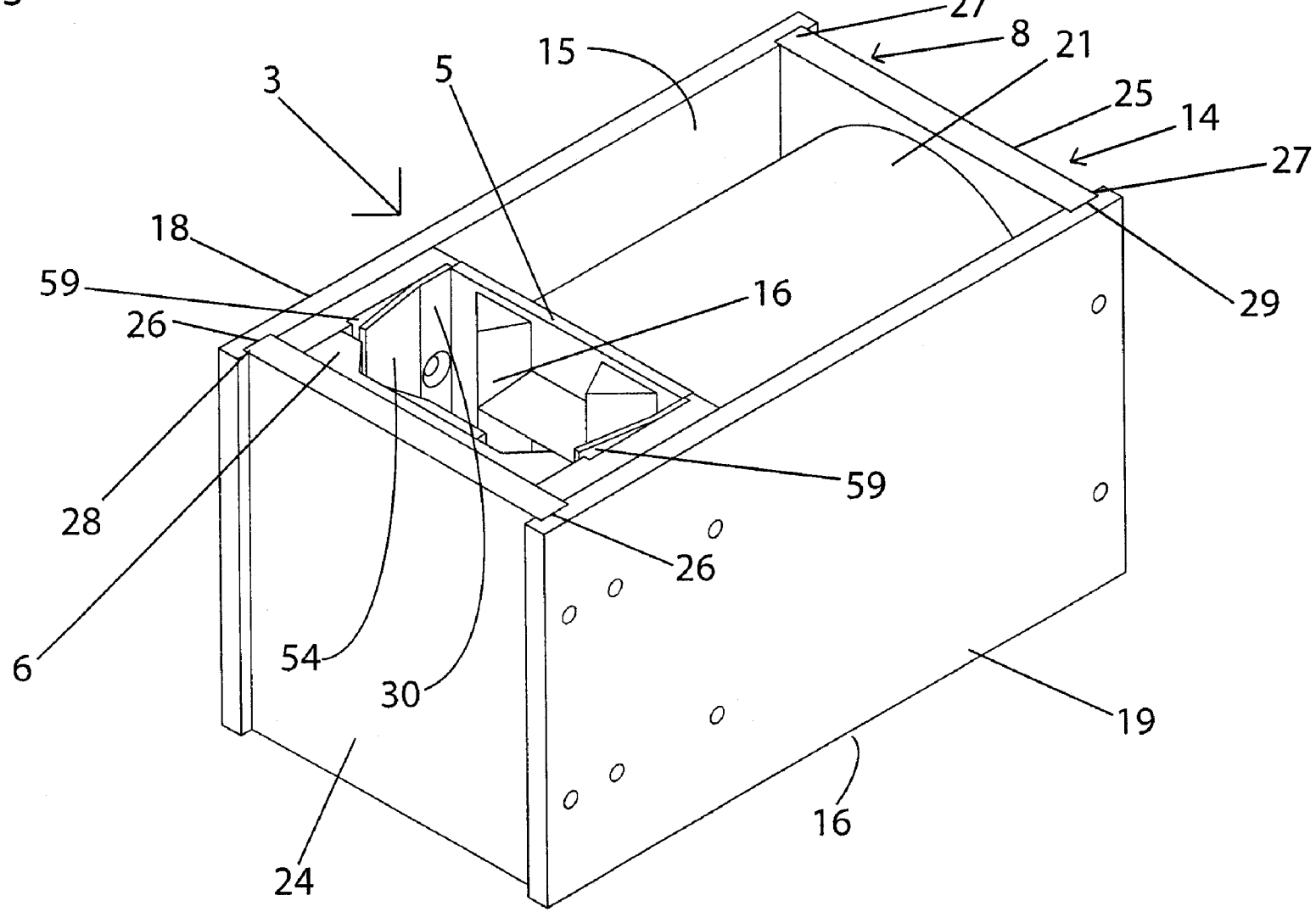
FIG. 3 is an enlarged perspective view of the crusher portion of the apparatus of FIG. 1.
Figure 4:
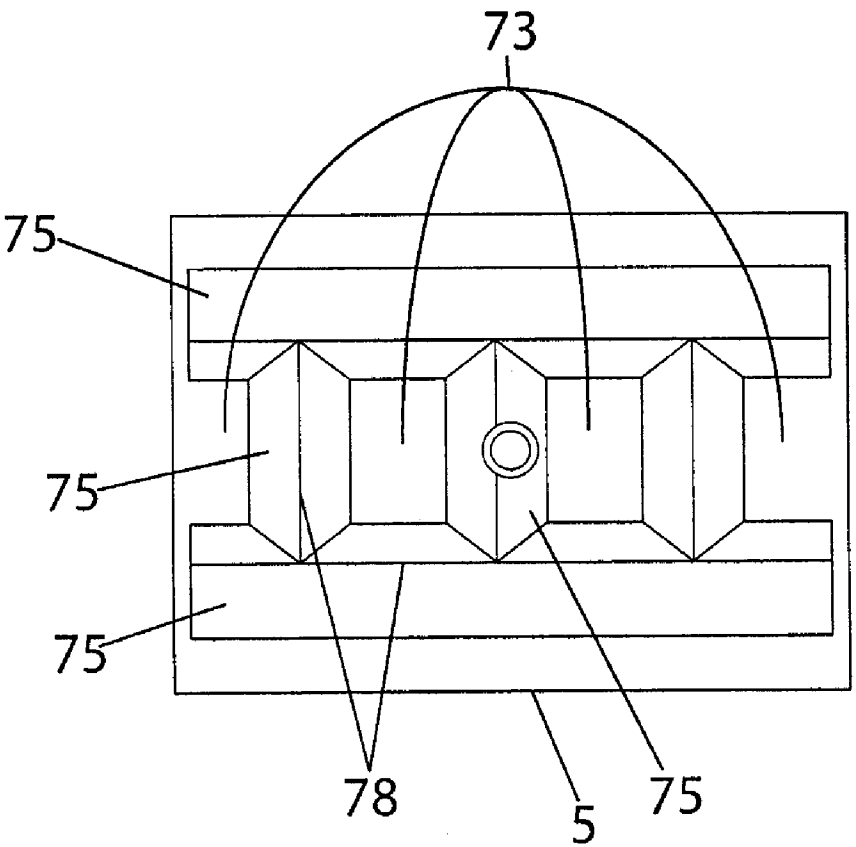
FIG. 4 includes a plan view and end view of a first crusher plate.
Figure 4:
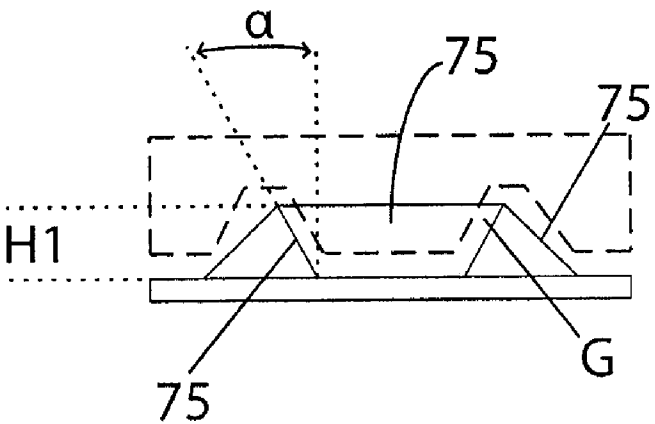
Figure 5:
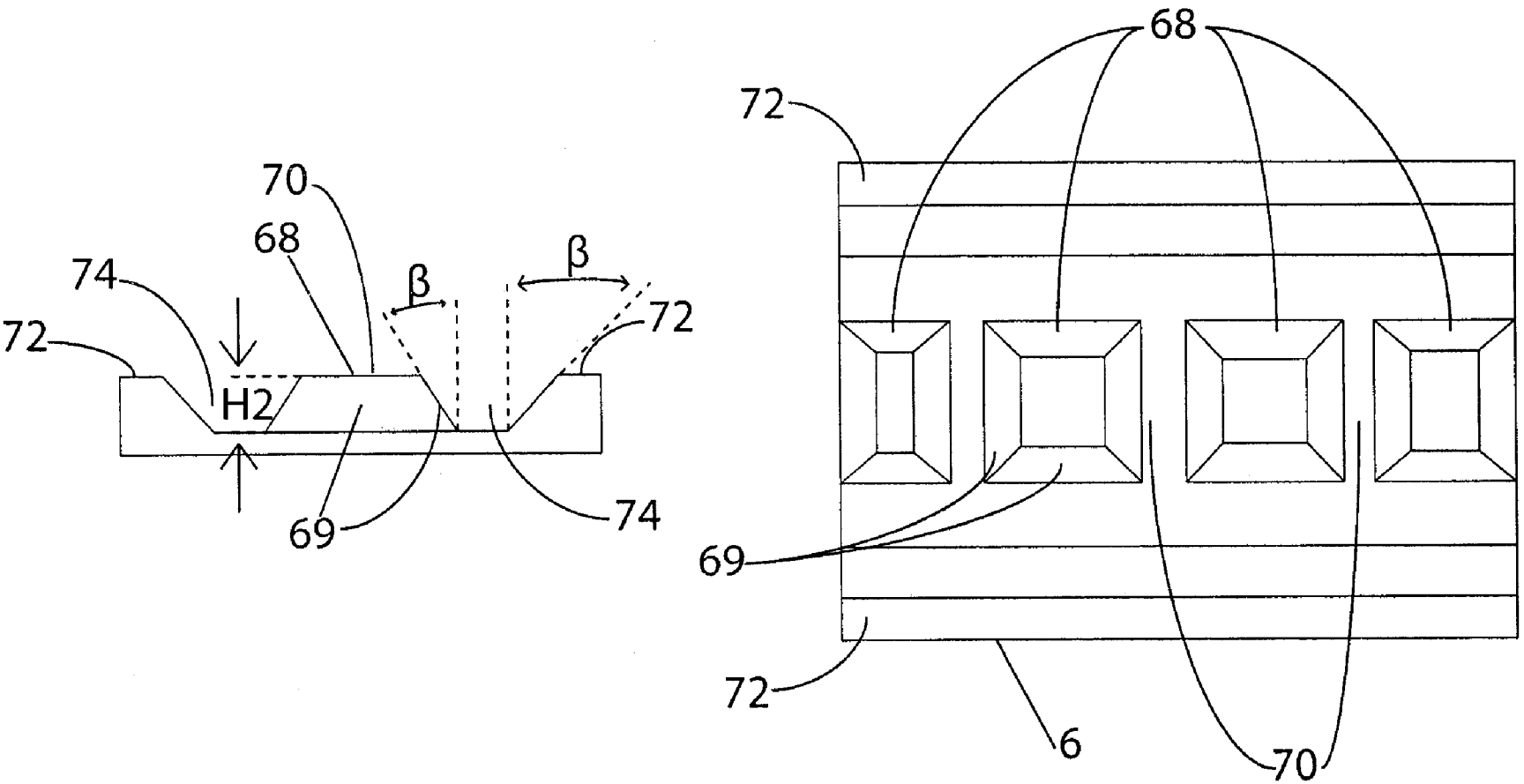
FIG. 5 includes a plan view and an end view of a second crusher plate.

The support assembly 8 is constructed to tie portions of the compression assembly 3 together so that force can be applied to a memory device 2 for its destruction. In a preferred embodiment, the support assembly 8 fixes the position of plate 6 and allows plate 5 to move toward and away from plate 6. The drive assembly 10 selectively effects the movement of the plate 5. The support assembly 8 (FIG. 3) carries at least a portion of the drive assembly 10. In the illustrated structure, the support assembly 8 is in the form of a box 14 having an open side 15 that allows access to the space 16 between the plates 5, 6 when they are in an open position. The box 14 includes tie members such as side tie walls 18, 19. End walls 24, 25 are also provided for the box 14 and generally close opposite ends of the box 14 and provide support for the plate 6 and for portions of the drive assembly 10. The walls 24, 25 are secured to the walls 18, 19 in any suitable manner such as with mechanical fasters such as bolts or rivets or permanently as by welding. As shown, edge margin portions 26, 27 of the walls 24, 25 are received in grooves 28, 29 in the inside faces of the walls 18, 19 to assist in assembly of the box 14 and resist shearing load between the walls 18, 19 and the walls 24, 25. Preferably, the walls 18, 19, 24, 25 are made of steel or other suitable metal alloy. In a preferred embodiment, the box has opposing open sides 15 and 20 for a purpose later described.

The drive assembly 10 is operable to selectively effect relative movement between the plates 5, 6 and apply force to a memory device 2 therebetween. In a preferred embodiment, only the plate 5 will move while plate 6 remains stationary in the support assembly 8. As shown, the drive assembly 10 includes a linear motion device, such as a double acting hydraulic cylinder 21. The plate 5 is mounted to a distal end portion of the piston rod or ram 22 and is movable thereby. The cylinder 21 is mounted on the end wall 24 and is preferably positioned inside the box 14. The length of stroke of the cylinder 21 is preferably such as to positively limit movement of the plate 5 between side stripper or ejector mounts 30, as described below, by bottoming out while moving between the mounts 30 upon extension and contraction. Movement of the plate 5 is limited laterally and rotationally by the mounts 30.

Figure 6:
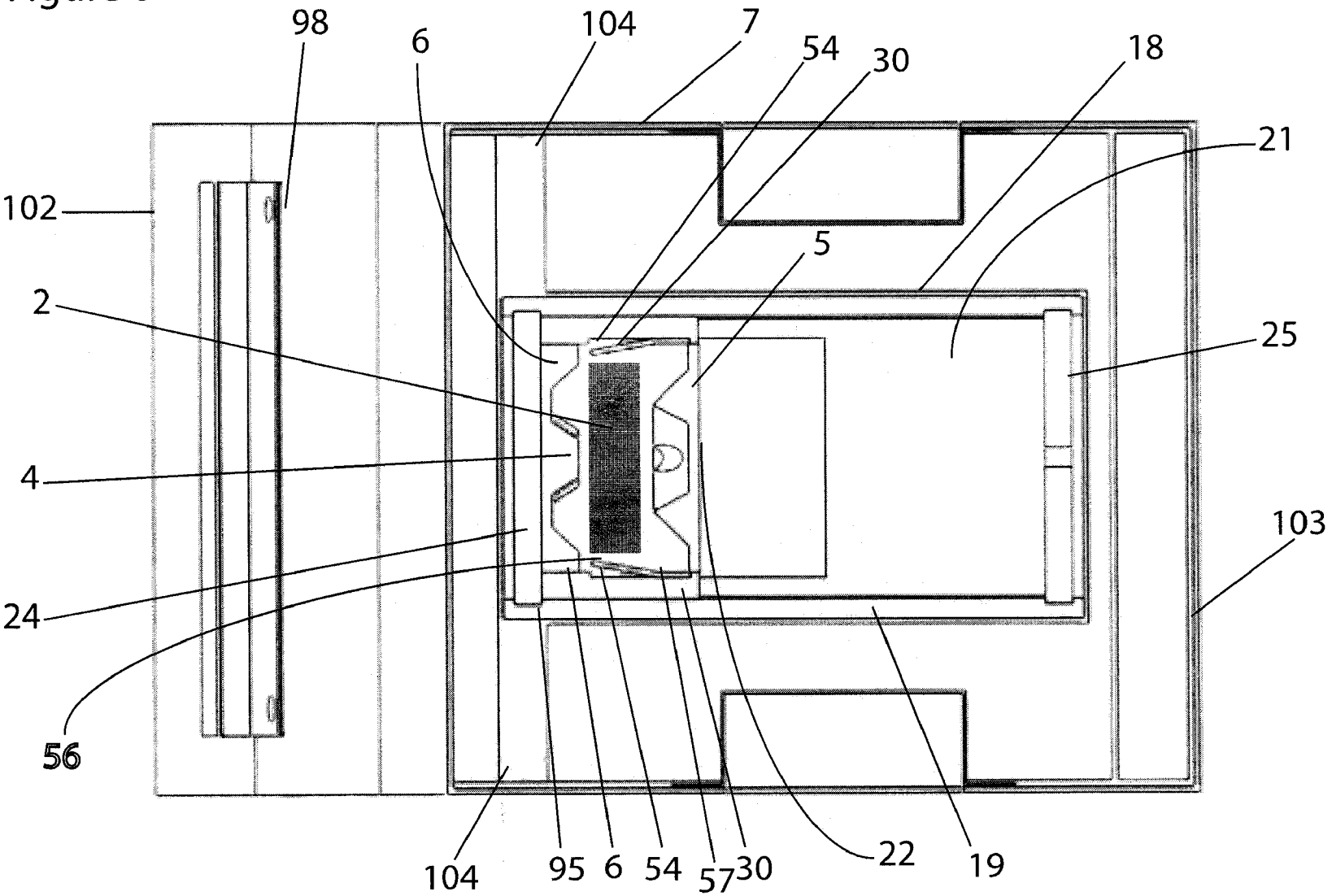
FIG. 6 is a fragmentary plan view with a portion of the cover removed to show the disk compression assembly.

FIG. 6 shows one form of power and control circuit portion of the drive assembly 8 for providing pressurized hydraulic fluid to the cylinder 21. Preferably, the hydraulic lines, pump and control valves are contained inside a base enclosure 31 while the operator controls, designated generally 32, are mounted to the outside of the box 14 on the exterior of a cover housing 85 described below. The controls 32 are part of a controller circuit 34 described below. The hydraulics include a pump system 33 including a pump P and motor M. The pump system 33 is operable to provide pressurized fluid from a fluid reservoir 35 to the cylinder 21. Hydraulic fluid can flow to and from the reservoir 35 during extension and retraction of the cylinder 21. A conduit 36 connects the outlet of the pump P to a valve 37 of the control circuit 34. The valve 37 may be a solenoid operated three position spool valve which selects whether pressurized fluid is fed to the cylinder 21 on the piston side through conduit 39 to extend the ram 22 or to the rod side through conduit 40 to retract the ram 22. Preferably the valve 37 is a spring return valve that allows the pump P to exhaust fluid to the reservoir 35 when the cylinder is not being extended or retracted. Exhausted hydraulic fluid from the cylinder 21 is returned to the reservoir 35 via conduit 43. As shown, a pressure switch 45 of the control circuit 34 is operably associated with the conduit 36 to sense fluid pressure therein. Optionally, the pressure switch 45 could be connected to the conduit 39. When a predetermined pressure is sensed in conduit 36, the switch 45 provides a signal to a valve controller 47 portion of the control circuit 34. The hydraulic system may also be provided with a pressure relief valve 44 connected to the conduit 36 and operable to effect discharge to the reservoir 35. A check valve 46 may also be provided in the conduit 36 to prevent reverse flow. As shown, the controller 47 includes a timer and relay switch. An operator control switch 53 is provided and when activated, the valve 37 is shifted to a position to feed pressurized fluid to the piston side of the cylinder 21 to effects its extension. After effecting start, the cylinder 21 may be operated automatically to extend and retract. A separate main power switch 48 may be provided to effect power on/off to the control system 34. As shown, the switch 48 can power the motor M on/off independent of operation of the state of the other control devices. The motor M could be powered on/off by the operator controller 32.

While the drive system 10 is illustrated and described as using a double acting hydraulic cylinder, it is to be understood that other drives can be used utilizing a linear moving drive device. For example, a toggle system could be used, an air powered system or an electric motor and screw could be used as linear actuators.

The crusher assembly 3 is shown as including the plates 5, 6, with one being movable and one being fixed. It also includes the stripper mounts 30 (FIGS. 2, 3, 6) and one or more stripper mechanisms 54 carried by the support assembly. The stripper mechanisms 54 are operably associated with the plate 5 whereby when the plate 5 moves thereby during movement away from the plate 6, the stripper mechanisms each have portion movable inwardly to engage a portion of a memory device 2 carried by the plate 5 and release a memory device from the plate 5. Preferably the stripper mechanisms 54 automatically operate to strip or eject a retained memory device 2 from retention on the plate 5. The stripper mechanisms 54 also limit lateral and rotational movement of the plate 5. As described, in a preferred embodiment of the invention, the movable plate 5 is configured to retain a crushed memory device 2 thereon in preference to retention on the plate 6 as described below. However, it is to be understood that the plate 6 could be configured to preferentially retain a crushed memory device 2. The stripper mechanism 54 will automatically strip a destroyed memory device 2, if retained, upon opening movement of the plate 5.

Preferably there is a stripper mechanism 54 on each of opposite side edges 58 of the plate 5, preferably the plate sides extending between the open sides 15, 20 of the box 14. As shown, a stripper mechanism 54 is mounted to a respective mount 30 in a removable manner as with mechanical fasteners 55 such as a bolts or cap screws with their heads each in a recess in the mount 30. A stripper mechanism 54 is in the form of a plate having a movable distal portion 56 and a proximal mount portion 57. The distal portion 56 lies in a plane at an angle to the plane of the mount portion 57 preferably at an angle in the range of between about 5 and about 30 depending on the height H of the distal portion. The stripper mechanism 54 is made of a resiliently deformable material such as spring steel. The distal portion 56 can move into and out of a recess 59 in the mount 30 to provide clearance for movement of the plate 5 by the stripper mechanism 54. When the plate 5 moves toward a closed position by the stripper distal portion 56, the distal portion 56 engages a respective side edge 58 of the plate 5 and resiliently moves outwardly. Upon the plate 5 moving towards an open position, the distal portion 56 moves inwardly to engage a crushed memory device 2 to strip it from retention on the plate 5 if it is retained thereon. The height H of the distal portion 56 is such as to provide enough inward movement to engage a retained memory device 2 and push it off during opening movement of the plate 5. Having a stripper mechanism 54 on opposite sides helps ensure stripping engagement. The stroke length of the cylinder 21 and the position of the plate 6 relative to the strippers 54 ensures that a top edge of the plate 5 does not go past the free edge of a distal portion 56.

The plates 5, 6 are preferably configured on the faces 65, 66, respectively, that generally face one another for crushing and bending a memory device 2. The faces 65, 66 are configured to provide positive predetermined bending of portions of a memory device 2 during crushing between the plates 5, 6. In addition, the contours on the faces 5, 6, are such as to bias retention of a device 2 on the plate 5 to assist in stripping, should a crushed device 2 adhere to a plate. The plate 6 is provided with one or more protuberances 68 (male projections) projecting toward the plate 5. As shown, the protuberances 68 are generally pyramidal having at least one side surface 69 and at least one top surface 70. Preferably, the protuberances 68 are generally rectangular in transverse cross section at least at their outer extremities and have four side surfaces 69. As shown, there is a single row of protuberances 68 separated by open ended valleys 71, but any suitable array may be used depending on the configuration of the plate 5 and the type and size of memory device 2 to be crushed. As shown, the plate 6 is provided with a pair of elongate protuberances 72 extending along side edge portions of the plate 6 having valleys 74 between them and the protuberances 68. Zone Name: A1,AMD,M The plate 5 has a corresponding cavity 73 (female cavity) for each protuberance 68 to be received in during closing movement of the plate 5. It is preferred that the cavities 73 be generally similar in cross sectional shape to the protuberances 68 and are generally rectangular at least at their outer extremities. It is noted that the end cavities 73 are shown as having an open side. When the plate 5 is in a closed position, there are gaps G between portions forming the cavities 73 and the protuberances 68 to allow portions of a crushed memory device 2 to be positioned in and not bind the plates 5, 6 together. As shown, the plate 5 includes a plurality of cavities 73 opening toward the plate 6. The cavities 73 are formed by ribs 75. In the case of rectangular cavities 73, it is preferred to provide four ribs 75 to define a cavity 73 with adjacent cavities sharing a rib 75. In a preferred embodiment, the ribs 75 defining a cavity 73 are connected together and one rib 75 forms a side of two adjacent cavities 73. The rib 75 extends outwardly from the face of the plate 5 to a height H1 corresponding to the approximate height H2 of the protuberances 68. The angle of incline of the surfaces 76 of the ribs 75 and the surfaces 69 along with the heights H1, H2 are chosen to ensure reliable predetermined bending of the data storage member inside the device 2. The angle of incline $\alpha$ from perpendicular is preferably less than about 29° and more preferably within the range of between about 28° and about 28.5° and the angle $\beta$ of the surfaces 69 is preferably greater than about 33° and more preferably in the range of between about 33° and about 33.5° . It is preferred that the angle $\beta$ be greater than the angle $\alpha$ to provide for the gaps G to diverge in width from the plate 5 toward the plate 6. The heights H1, H2 are preferably greater than about 12 cm and preferably in the range of between about 12.5 cm and about 16.5 cm. The ribs 75 have an apex 78 between opposite surfaces 76. It is preferred that the apexes have a width of less than about 0.25 cm and more preferably, the ribs 75 are V-shaped with a relatively sharp apex. The angle $\alpha$ and the height H1 are chosen relative to the shape of the protuberances 68, 72 to bias retention of a compressed memory device 2 on the plate 5. A large majority of memory devices 2 include an external case made from metal. Inherently, when a metal is crushed it will bend and has a resiliency to try to spring back to its original shape. This resiliency of the metal combined with the angle of inclination of the ribs 75 on plate 5 enable the crushed memory device to be retained on the plate 5. Subsequently, the stripper mechanisms 53 will remove the memory device from the plate.

Figure 2:
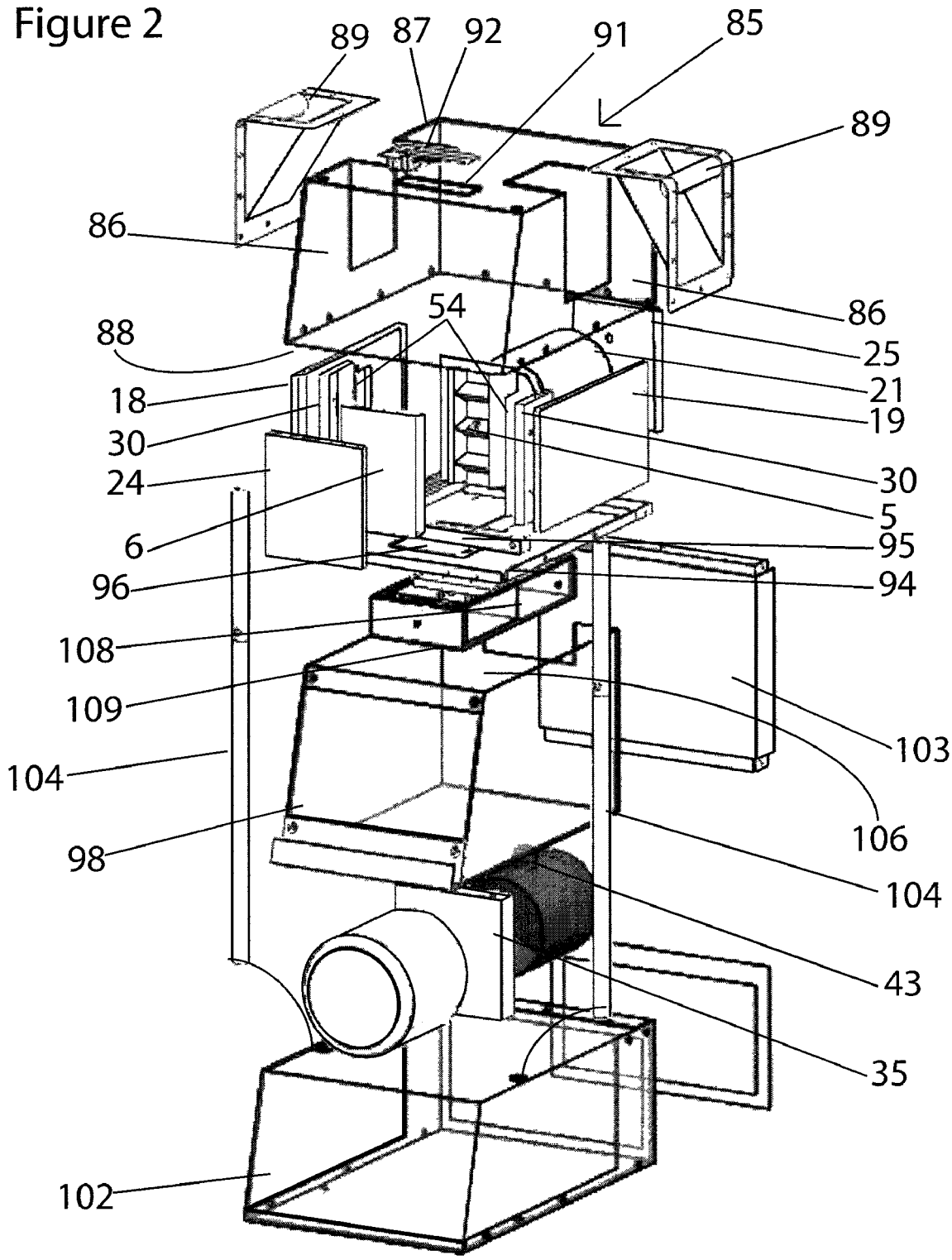
FIG. 2 is an exploded perspective view of the apparatus of FIG. 1.

The apparatus 1 includes the enclosure 7. As seen in FIGS. 1, 2, 6 and 7, the enclosure 7 includes a top housing 85 that encloses the compression assembly 3 and at least portions of the drive assembly 10. It has side and top wall 86, 87 respectively and has an open bottom 88 to permit removal from the enclosure. The housing 85 also has handles 89 to assist in moving the apparatus 1 and removal of the top housing 85. As seen in FIGS. 1, 2, the housing 85 is also provided with a feed opening 91 through the wall 87 adjacent the space between plates 5, 6 at the open side 20. In use, a memory device 2 can be fed into the apparatus through the opening 91 for processing. The housing 85 shields the components therein from accidental contact and from any accidental discharge of a part of the device 2 from ejection during compression. An entry door 92 (FIG. 2) is provided at the opening 91 and mounted to the housing 85 for movement to selectively close the opening 91. An interlock switch 93 may also be mounted to the housing 85 to cooperate with the door 92 and provide a signal that the door 92 is in an open or closed position and if open to at least prevent or stop the cylinder 21 from moving to an extended position. The switch 93 may also be used to shut down the whole control system 34. The housing 85 has a bottom wall 94 at its open bottom 88. A mount 95 may be secured thereto for securing the support assembly 3 in place. A discharge opening 96 forms a discharge path for a crushed device 2 to pass through into a discharge hopper 98 located below the wall 94 and the plates 5, 6. The discharge hopper 98 is located above a riser housing 102 that rests on a floor or elevated work surface. In the illustrated structure, the housing 102 is tied to the housing 85 and mount 95 via tie rods 104. The hydraulic system, including pump P, motor M, reservoir 35 and the valves 37, 44, 46 may be housed in the housing 102 and the conduits 39, 40 may extend through a duct 103 to the cylinder 21 in the housing 85. The hopper 98 is movable relative to the housings 85, 102 and has an open top to allow access to an interior storage chamber 106 to remove crushed memory devices 2 therefrom.

Figure 7:
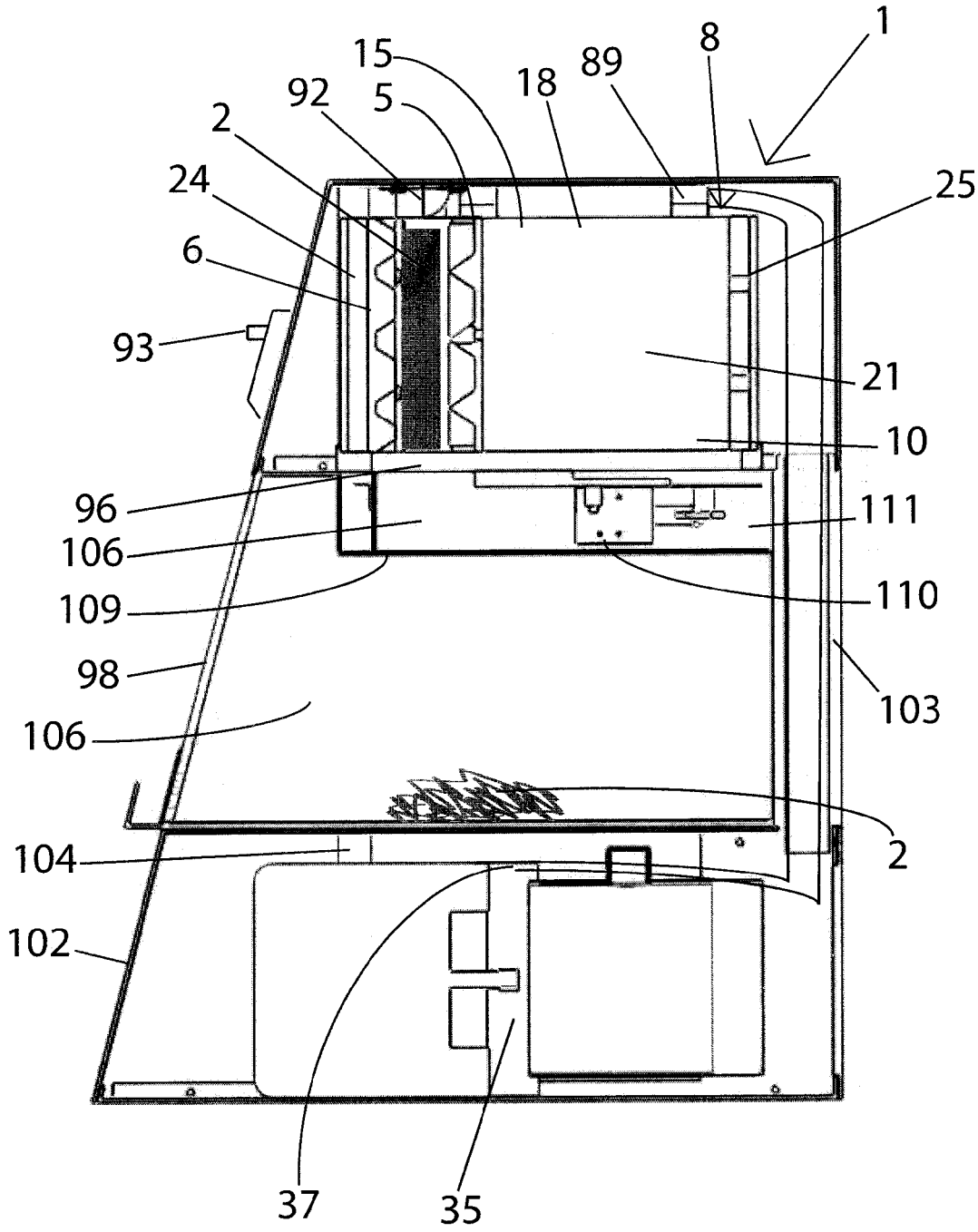
FIG. 7 is a fragmentary side view with side walls removed to show the interior of the apparatus of FIG. 1.
Figure 8:
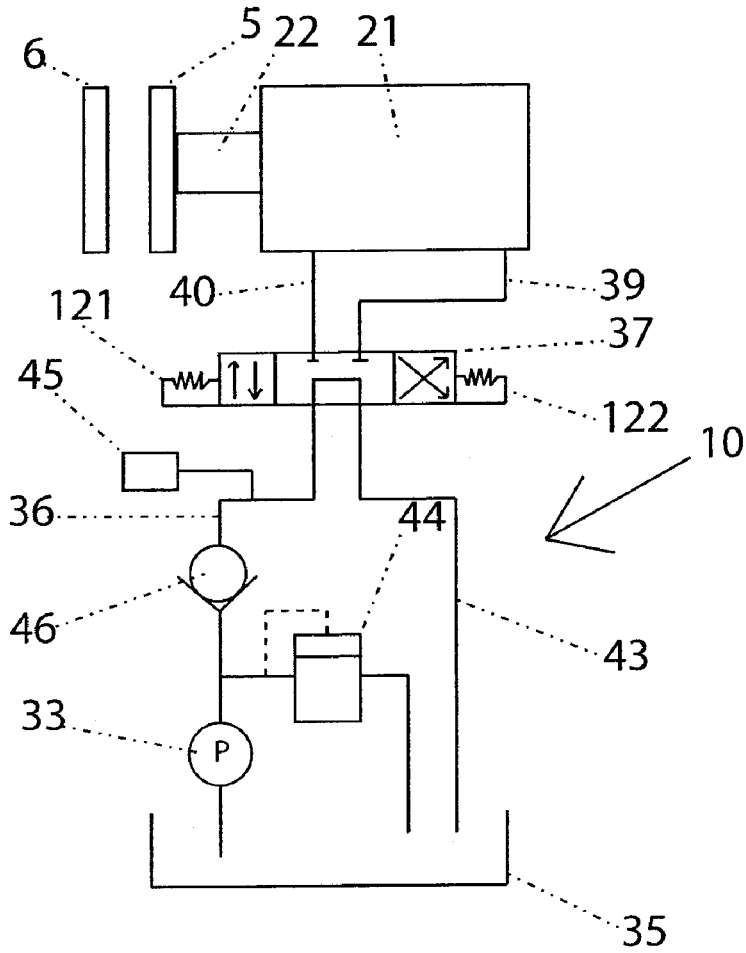
FIG. 8 is a schematic view of a hydraulic and control system.
Figure 9:
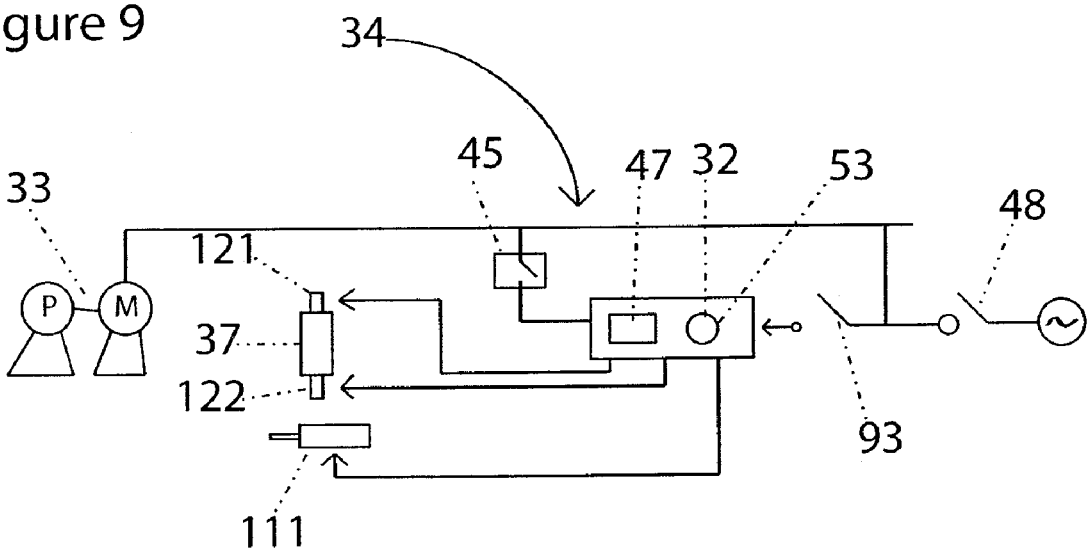
FIG. 9 is a simplified schematic of the electrical control circuit.

The apparatus 1 is provided with means to allow the selective discharge of a crushed device 2 from a location between plates 5, 6 to the storage chamber 106 in hopper 98. The hopper 98 slidably rests on the riser 102 and may be moved outwardly to expose the chamber 106 for removal of crushed drives 2 or removed to dump out crushed drives 2. As seen in FIG. 7, a gate 108 is movably mounted adjacent the opening 96 and is operable to selectively close and open the opening 96 and function as a trap door. The gate 108 is positioned on the bottom side of the wall 94. The gate 108 is in a closed position when the plates 5, 6 are in the open position and ready to receive a device 2 therebetween for crushing. When the plate 5 moves to an open position, the gate 108 can also move to an open position allowing a crushed device 2 to pass through opening 96. The gate 108 can be supported by guides 109 secured to the wall 94. The gate 108 is connected to a drive assembly 110 to effect its selective movement to open and close the opening 96. As shown, the drive assembly 110 includes a solenoid 111 operably connected to the control circuit 32 to effect its operation.

The present invention is better understood by a description of it operation. A memory device 2 is placed between the plates 5, 6 by placing through opening 91 and past door 92. The plates 5, 6 are generally vertically disposed providing a generally vertically disposed passage therebetween. The operator selects manual or automatic mode with control switch 53. The door 92 must be closed as indicated by switch 93. The valve 37 is shifted by energizing solenoid 122 to allow the cylinder 21 to extend. The plate 5 moves generally horizontally toward the plate 6 with the memory device 2 in the space between the plates 5, 6. The plate 5 applies force to the memory device 2 from the cylinder 21 to effect positive and predetermined bending of portions of the memory device 2 over the ribs 75 and the protuberances 68, 72 to ensure fracture of the data storage media inside the device 2 and to destroy the device 2 by compression. Retention of a compressed memory device 2 is biased to the plate 5 and if retained, the stripper mechanism 53 automatically releases a compressed memory device from retention on plate 5 upon moving the plates 5, 6 apart during opening movement. When a predetermined pressure is reached, as indicated by the pressure switch 45, a signal is sent to a timer in valve controller 47 and once a predetermined amount of time expires, a signal is sent to solenoid 121 of valve 37 to effect retraction of the cylinder 21. After full retraction, the valve 37 can return to neutral by having both solenoids 121, 122 de-energized. The solenoid 111 is then energized to open the door 108 to open and let a crushed device 2 to fall into hopper 98. The apparatus may operated in an automatic mode by selection of that mode with control switch 53. In automatic mode, the door switch 93 will activate the crush cycle by dropping a device 2 through the door 92. The door 92 must be closed before the hydraulic cylinder 21 can extend. The device then functions as described above. A drive actuator (not shown) may be used to open and close the door 92 if desired and can operate via a time delay relay switch.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. An apparatus for destroying electronic memory media apparatus at least partially by compression, said apparatus including:

a support assembly;

a drive apparatus carried by the support assembly having a linearly movable ram;

a control system operably coupled to the drive apparatus and operable to selectively control movement of the ram;

a first plate mounted to the first member and movable therewith and having an exposed first face with at least one outwardly opening cavity, said cavity having at least one side being at least partially defined by at least one rib projecting from the first plate;

a second plate carried by the support assembly and having an exposed second face facing generally toward the first face, said second plate having at least one protuberance projecting therefrom and sized and shaped to fit within a respective said first cavity;

a stripper mechanism carried by the support assembly and operably associated with the first plate whereby when the first plate moves thereby during movement away from the second plate the stripper mechanism having a portion movable inwardly to engage a portion of a memory device carried by the first plate and release a memory device from the first plate, said stripper mechanism includes a stripper plate carried by the support assembly, said stripper plate having a distal portion engaging the first plate and movable by said first plate to a retracted position during movement of the first plate toward the second plate and movable toward an extended position during movement of the first plate away from the second plate; and wherein the at least one said rib and the protuberance being constructed and arranged to retain a crushed memory device on the first plate during retraction of the first plate by movement of the ram.

2. The apparatus of claim 1 wherein said at least one said cavity having a plurality of sides.

3. The apparatus of claim 2 wherein said at least one cavity having a generally rectangular perimeter.

4. The apparatus of claim 3 further including a plurality of said cavities.

5. The apparatus of claim 4 further including a plurality of said ribs, at least some of said ribs forming rectangular arrays forming sides of said first cavities.

6. The apparatus of claim 1 wherein said at least one rib having a first surface portion forming a side of said first cavity, said first surface portion having a first angle of incline from perpendicular to the first plate of less than about 29°.

7. The apparatus of claim 6 wherein said at least one cavity having a depth of at least 16 cm.

8. The apparatus of claim 7 wherein the at least one protuberance having a second surface portion defining a side thereof, said second surface portion having a second angle of incline from perpendicular to the second plate of at least about 33°.

9. The apparatus of claim 8 wherein the second angle of incline being greater than the first angle of incline.

10. The apparatus of claim 1 wherein the at least one rib being defined by a plurality of first surface portions on opposite sides thereof and converging toward a first apex.

11. The apparatus of claim 10 wherein the apex having a width of less than about 0.25 cm.

12. The apparatus of claim 1 wherein the at least one cavity and the first protuberance having similar cross sectional shapes.

13. The apparatus of claim 12 wherein said shape of the at least one cavity and the first protuberance being generally rectangular at their outer exposed perimeter.

14. The apparatus of claim 13 wherein the shape of the at least one cavity and the first protuberance being generally pyramidal.

15. The apparatus of claim 1 wherein the stripper plate being positioned adjacent a first side edge of the first plate and said distal portion of the first stripper plate being movable within an outer perimeter of the first plate during movement of the first plate away from the second plate.

16. The apparatus of claim 15 wherein the first stripper plate having a fixed portion and a resiliently movable portion, the fixed portion being secured to the support assembly and the resiliently movable portion being positioned to engage the first plate during at least a portion of movement of the first plate toward and away from the second plate and being resiliently biased toward the extended position.

17. The apparatus of claim 16 wherein the resiliently movable portion includes a free edge portion adapted to engage a memory device after compression between said first and second plates and free it from retention on said first plate.

18. The apparatus of claim 17 wherein there being at least two said stripper plates each positioned on a respective side of the first plate.

19. An apparatus for destroying electronic memory media apparatus at least partially by compression, said apparatus including:

a support assembly;

a drive apparatus carried by the support assembly having a linearly movable ram;

a control system operably coupled to the drive apparatus and operable to selectively control movement of the ram;

a first plate mounted to the first member and movable therewith and having an exposed first face with at least one outwardly opening first cavity;

a second plate carried by the support assembly and having an exposed second face facing generally toward the first face, said second plate having at least one protuberance projecting therefrom and sized and shaped to fit within a respective said first cavity to effect predetermined bending of a memory device during crushing;

a stripper mechanism carried by the support assembly and operably associated with the first plate whereby when the first plate moves away from the second plate the stripper mechanism having a portion movable inwardly to engage a portion of a memory device carried by the first plate and release a memory device from the firsts plate, said stripper mechanism includes a stripper plate carried by the support assembly, said stripper plate having a distal portion engaging the first plate and movable by said first plate toward the second plate and movable toward an extended position during movement of the first plate away from the second plate;

an enclosure housing the ram the first and the second plates and including an opening adjacent a space between the first and second plates for inserting a memory device into the space for crushing and a hopper positioned below the first and second plates for receipt of a crushed memory device therein; and a door associated with the opening and operable for selectively closing the opening.

20. The apparatus of claim 19 wherein the cavity and the protuberance being configured to bias retention of a crushed memory device on the first plate during retraction of the first plate by movement of the ram.

21. The apparatus of claim 19 wherein said cavity having at least one side being at least partially defined by at least one rib projecting from the first plate, said rib having an apex and the second plate having a said protuberance positioned on opposite sides of the first rib to effect bending of a memory device over the said apex.

22. The apparatus of claim 19 wherein the control system including a timer operable to maintain the first member in an extended position for a predetermined period of time.

23. The apparatus of claim 22 wherein the drive apparatus including a fluid drive system and the control system including a pressure switch operable to sense fluid pressure in the drive system and at a predetermined pressure provide a signal to the timer to effect start of predetermined period of time.

24. The apparatus of claim 19 wherein the first and the second plates are generally vertically disposed and the first plate being movable generally horizontally.

* * * * *